US005178690A

United States Patent [19]

Maiquez

[11] Patent Number: 5,178,690

[45] Date of Patent: Jan. 12, 1993

[54] PROCESS FOR SEALING CHROMATE CONVERSION COATINGS ON ELECTRODEPOSITED ZINC

[75] Inventor: Jose A. O. Maiquez, Barcelona, Spain

[73] Assignee: Enthone-OMI Inc., West Haven, Conn.

[21] Appl. No.: 878,374

[22] Filed: May 4, 1992

[30] Foreign Application Priority Data

May 13, 1991 [ES] Spain ..... 9101162

[51] Int. Cl.[5] ..... C23C 22/83

[52] U.S. Cl. ..... 148/265

[58] Field of Search ..... 148/265, 268

[56] References Cited

U.S. PATENT DOCUMENTS 2,548,420 4/1951 Chester ..... 148/265

4,367,099 1/1983 Lash ..... 148/265

*Primary Examiner*—Sam Silverberg

*Attorney, Agent, or Firm*—Richard P. Mueller

[57] ABSTRACT

A process for forming improved chromate conversion coatings on zinc surfaces by treating the zinc surface with an aqueous acidic chromating solution which contains hexavalent chromium and a soluble inorganic salt which has an cation which will form an insoluble organic silicate and, thereafter, treating the thus-formed chromate conversion coating with an aqueous alkaline silicate solution which contains a soluble alkali metal silicate and fluoride ions.

9 Claims, No Drawings

PROCESS FOR SEALING CHROMATE CONVERSION COATINGS ON ELECTRODEPOSITED ZINC

BACKGROUND OF THE INVENTION

The present invention relates to a process for increasing the chemical resistance of parts which have been electroplated with zinc followed by a chromate coating, especially steel parts for use in the automotive industry. More particularly, the present invention relates to an improved process for sealing chromate conversion coatings on electrodeposited zinc, thereby increasing the chemical resistance of the zinc plated parts.

In recent years, the automotive industry has required an ever increasing degree of protection against corrosion of parts which have been electroplated with zinc and then coated with a yellow, black, white or green chromate. This need of increased corrosion protection is particularly important for zinc plated parts which are in the automobile engine compartment and thus, continually subjected to high temperatures. When such parts have been treated with conventional chromate coatings, these high temperatures cause the layer of coating, which normally contains $Cr(OH)_3$ and —CrOH—$CrO_4$—$H_2O$, to lose its water of crystallization, thereby causing a significant reduction in the chemical resistance of the coating. Typically, when such parts are subjected to temperatures of about 120° C. for only two (2) hours, their resistance to corrosion, as measured by the saline fog test (ASTM B117, 5% neutral sodium chloride) is only about 40 or 50 hours. For present automotive requirements, such results are unacceptably low by a factor of at least 10.

In an attempt to improve the corrosion resistance of such zinc plated/chromated parts, different approaches have been explored. For example, U.S. Pat. No. 4,800,134, discloses a process for producing a a steel-clad roll having high chemical resistance. In this process, the steel substrate is electroplated to form a base layer of a zinc or zinc alloy matrix. To this base layer is applied a layer of particles of water insoluble chromate combined with colloidal particle or additional fines of $SiO_2$, $TiO_2$, $Cr_2O_3$, $Al_2O_3$, $ZrO_2$, $SnO_2$ and/or $SbO_5$. Thereafter, an additional electroplated coating is formed which contains zinc, iron, cobalt, and/or manganese, and this coating is followed by a layer of an organic resin coating and/or an additional layer of electroplated coating. Although, the coated steel substrate produced by this process has high chemical resistance, the number of steps required in the process make it economically unattractive. Additionally, the use of colloidal particles often causes difficulties in obtaining uniform coating layers.

In European Patent Application No. 86307929.9, a process is described for improving the chemical resistance of a zinc or cadmium plated metal article. In this process, the zinc or cadmium plated part is coated with a chromate solution to form a yellow to matt olive chromate coating. Thereafter, the conversion coated article is immersed in a silicate solution for a period of time sufficient to produce an acceptable white-gray colored coating on the surface. Although this process does provide some increase in the chemical/corrosion resistance of the coating, the corrosion resistance obtained is still unacceptably low for present automotive requirements.

In spite of the efforst which have been expended, the object of producing, economically, a zinc plated/chromate conversion coated steel substrate having high chemical/corrosion resistance has not been achieved.

SUMMARY OF THE INVENTION

In accordance with the present invention, a process is provided wherein zinc electroplated steel parts are provided with a coating which significantly increases the resistance of the parts to corrosion, even when the coated parts have been subjected to elevated temperatures. In this process, the steel parts are electroplated with zinc. The plated parts are then treated, preferably by immerision, with an aqueous acidic chromate solution containing inorganic salts which are soluble in the solution and which have an cation which is capable of forming an insoluble inorganic silicate. The zinc plated parts are treated with this chromating solution for a period of time sufficient to form the desired chromate conversion coating on the zinc surface. The chromated parts are then treated, again preferably by immersion, with an aqueous alkaline sealing solution containing a soluble inorganic silicate and fluoride ions. Following the treatment with the sealing solution, the parts are dried. The thus treated parts are found to have a shiny, white to greenish colored chromate/silicate coating which provides excellent corrosion resistance to the zinc plated parts, even after being heated at elevated temperatures.

Parts which have been treated in accordance with the foregoing process, when subjected to the salt fog test (ASCM B117, 5% neutral sodium chloride) are found to provide between 600 to 800 hours resistance to white corrosion and up to 1800 hours resistance to red corrosion. Similar results are obtained when the treated parts are heated from one to two hours at 120 degrees C. before being tested. The present invention thus provides, in a simple two-step process, zinc plated parts having corrosion resistance which is improved by a factor of more than 10 as compared to the typical chromate coatings of the prior art.

Other advantages and benefits of the present invention will be readily appreciated by those skilled in the art in light of the following description of the preferred embodiments taken in conjunction with the examples given below and the claims appended herewith.

DESCRIPTION OF THE PREFERRED EMBODIMENT

In the practice of the present invention, the parts to be treated are typically steel, although they may be formed of other metal which can be zinc electroplated. The parts may be of any shape which can be electroplated. Typically, where the present invention is practiced in the automotive field, the steel parts to be treated are in the form of steel sheet, strip, coil stock, and the like.

The steel parts are electroplated with zinc in the conventional manner to provide an electrodeposited zinc coating of the desired thickness on the surface of the steel parts. The zinc electroplating may be carried out using any of the commerical zinc electroplating baths, including cyanide baths, acid baths, alkaline non-cyanide baths, and the like. Once the desired thickness of zinc has been electroplated on the surface of the steel parts, the parts can then be subjected to the chromating and sealing steps of the present invention.

The chromating and sealing steps of the present invention may be carried out on the treated steel sheets immediately after the zinc electroplating, as a continuous process, or they may be applied to parts which have been previously electroplated in a separate operation. Preferably, the chromating and sealing steps are carried out immediately after zinc electroplating in order to ensure that corrosion of the plated parts has not occurred in the interval between plating and chromating. Typically, the plated steel parts are removed from the electroplating bath and water rinsed to ensure that there is no carry over of electroplating solution from the plating bath into the chromating baths.

The zinc plated parts are treated with the chromate solution of the present invention in any convenient manner which will provide the desired chromate coating on the zinc surface. Typically, the treatment is carried out by immersing the zinc plated parts in the chromating solution, although other methods such as spraying, flooding or the like, may also be used.

The chromating solution is an aqueous acidic solution having a pH of from about 0.6 to about 2.2, which solution contains aneffective amount of hexavalent chromium and an inorganic salt which is soluble in solution and which contains an cation which is capable of forming an insoluble inorganic silicate. The acidity of the chromating solutution is typically provided by nitric acid, although other inorganic acids which are not deleterious to the chromating solution or the subsequently applied silicate sealing solution may also be used. The source of hexavalent chromium in the solution is typically chromic acid although other hexavalent chromium materials, such as the alkali metal chromates and dichromates may also be used. The inorganic salts which are also in the chromating solution may be any which are soluble in the chromating solution and which have an cation or metal which will form an insoluble inorganic silicate. Typical of the inorganic salts which may be used are the alkaline earth metal compounds, including the alkaline earth metal sulfates, carbonates, nitrates, chlorides and the like. Additionally, lithium compounds, such as lithium carbonates, have also been found to be useful. In a particularly preferred embodiment, magnesium sulfate, either alone or in combination with lithium carbonate, had been found to provide excellent results in the method of the present invention. Additionally, in a most preferred embodiment of the chromating solution, there is included a suitable buffering agent. Although any compatible buffering agent may be used, an organic acid, such as acetic acid, formic acid, oxalic acid or the like, is generally preferred.

Typically, the chromating solutions of the present invention will contain the following components in the amounts indicated:

| Component | Amount in g/l |
|---|---|
| Chromic Acid | 2–15 |
| Magnesium Sulfate (heptahydrate) | 0.5–15 |
| Nitric Acid | 0.5–5 |
| Lithium Carbonate | 0.02–2 |
| Acetic Acid | 0–10 |
| Water | to make 1 liter |

Preferably, the composition of the chromating solution will be as follows:

| Component | Amount in g/l |
|---|---|
| Chromic Acid | 6–9 |
| Magnesium Sulfate (heptahdyrate) | 1.2–2.5 |
| Nitric Acid | 3–3.5 |
| Lithium Carbonate | 0.05–0.06 |
| Acetic Acid | 2.2–3 |
| Water | to make 1 liter |

In making up these solutions, water from any source may be used. Generally, however, it is preferable to use distilled or dionized water in view of the variations in quality which may be encountered when using tap water.

In using the above solutions, the zinc plated steel parts are treated with solutions, preferably by immersion, for a period of time sufficient to form the desired chromate coating on the zinc surface. Typically, the treatment time will be from about 10 or 15 seconds up to two or three minutes, with treatment times of from about 30 seconds to 1 minute being preferred. During the time of treatment, the chromating solutions are maintained at a temperature which is typically within the range of about 20 to 30 degrees C., with temperatures of about 25 degrees C. being preferred.

Following the treatment with the chromating solution, the parts are water rinsed to minimize the carry over of chromating solution into the next treatment stage. The parts are then treated with a silicate sealing solution which is an aqueous alkaline solution having a pH of at least 9 and containing an effective amount of a soluble inorganic silicate and fluoride ions. As with the chromating solution, the treatment of the chromated parts with the silicate sealing solution may be carried out in any convenient manner, with treatment by immersion of the parts in the solution being preferred.

The aqueous alkaline silicate sealing solution typically will have a pH within the range of about 9 to 13 and will contain a soluble alkali metal silicate, preferably sodium silicate. The sodium silicate used in this solution may have an $SiO_2$:$Na_2O$ ratio of from about 2 to 5:1 with ratios of from about 3 to 4.5:1 being preferred. The silicate sealing solutions will also contain a source of fluoride ions, which has been added as a soluble inorganic fluoride. Typically, the inorganic fluoride compounds used are the alkali metal fluorides, such as sodium fluoride or potassium fluoride. The presence of the fluoride ion in the sealing solution has been found to cause this solution to make a slight attack on the surface of the chromate coating. This, in turn, serves to enhance the reaction of the chromate layer with the silicate ions in the sealing solution to form the chemically resistant insoluble silicate coating.

In addition to the silicate and fluoride, the silicate sealing solution of the present invention, optionally, may also contain an inorganic salt having a metal or cation which will form insoluble inorganic silicates, as is contained in the chromating solution, as well as inhibitors for the zinc metal and surface active agents. When these components are included in the silicate sealing solution, the inorganic salt is preferably lithium carbonate, the zinc inhibitor is preferably a triazol phosphoric ester and the surface active agent is preferably a cationic surface active agent. Typical of the phosphoric esters of triazol which may be included in the silicate sealing solutions, are those sold by Sandoz AG under the tradename Sandocorin, such as Sandocorin 8015, 8032, 8132, 8160, and the like. Additionally, other known metallic corrosion inhibitors, such as those based on imadazoles, thiazoles, and the like may also be used. Although any suitable cationic, anion or non-ionic surface active agent may be used in the silicate sealing solution, particularly good results have been obtained when using fluorinated surface active agents such as those supplied by 3M Company under the name Fluorad, and in particular, the fluorinated cationic surface active agents Fluorad FC135.

Typically, the silicate sealing solution of the present invention will contain the following components in the amounts indicated:

| Component | Amount in g/l |
|---|---|
| Sodium Silicate ($SiO_2$:$Na_2O$ = 2-5:1) | 150-250 |
| Sodium fluoride | 1-8 |
| Lithium carbonate | 0-2 |
| Triazol phosphoric ester | 0-8 |
| Cationic Surface Active Agent | 0-1 |
| Water | to make 1 liter |

and, preferably, the solutions will have the following formulation:

| Component | Amount in g/l |
|---|---|
| Sodium Silicate ($SiO_2$:$Na_2O$ = 3-4:1) | 180-200 |
| Sodium fluoride | 3-5 |
| Triazol phosphoric ester | 3-5 |
| Lithium carbonate | 0.2-0.3 |
| Cationic Surface Active Agent | 0.02-0.03 |
| Water | to make 1 liter |

The chromated zinc plated parts will be treated in the silicate sealing solutions, preferably by immersion, for a period of time sufficient to form the desired silicate coating on the surface. Generally, this time will be from about 30 seconds to 5 minutes, with times of about 1 to 2 minutes being typical. During the treatment time, the silicate sealing solutions are desirably maintained at an elevated temperature, generally between about 55 and 80 degrees C. with temperatures of from about 60 to 75 degrees C., being typical. Thereafter, the treated parts are allowed to dry before being used, with drying times at room temperature of from about 1 to 3 days being typical.

The parts treated in accordance with the above process are found to have a shiny, white to greenish color. When these parts are tested in the saline fog test (ASTM B117, 5% neutral sodium chloride), even after being subjected to a heat treatment of from 1 to 2 hours at 120 degrees C., the parts are found to have from 600 to 800 hours resistance to white corrosion and at least as much as 1800 hours resistance to red corrosion.

In order that those skilled in the art may better understand the method of the present invention and the manner in which it may be practiced, the following specific examples are given.

EXAMPLE I

A steel sheet (100 mm×50 mm) was immersed in an acid zinc electrolyte and plated at 2.5 A/dm$^2$ for 20 minutes at 25 degrees C. After washing it with tap water, the steel sheet was immersed in a solution of yellow chromate with the following formulation:

| | |
|---|---|
| chromic acid | 6 g/l |
| magnesium sulphate heptahydrate | 2.5 g/l |
| acetic acid | 2.2 g/l |
| nitric acid | 3.2 g/l |
| lithium carbonate | 0.05 g/l |
| distilled water | to make 1 liter |

for a period of 30 seconds at a temperature of 25 degrees C.

The sheet was then washed with tap water and immersed in a sealing solution having the following formulation:

| | |
|---|---|
| Sodium silicate ($SiO_2$:$Na_2O$ 4:1) 23% $SiO_2$ | 200 g/l |
| lithium carbonate | 0.2 g/l |
| sodium fluoride | 3 g/l |
| triazol phosphoric ester (Sandocorin 8015 liquid) | 3 g/l |
| cationic surface active agent (Fluorad FC135) | 0.02 g/l |
| distilled water | to make 1 liter |

for a period of 1 minute at a temperature of between 65 and 70 degrees C. and a pH of 11.

The sheet was then left to dry without prior washing and allowed to stand for 48 hours before making the corrosion test. After this period of time, thermal treatment was applied for 1 hour at 120 degrees C.

The sheet withstood 750 hours for white corrosion (ASTMB117), NaCl 5% neutral).

EXAMPLE 2

A sheet of steel (100 mm×50 mm) was immersed in a zinc cyanide electrolyte and plated at 3 A/dm$^2$ for 15 minutes at 25 degrees C. After washing it with tap water, the steel sheet was immersed in a solution of yellow chromate with the following formulation:

| | |
|---|---|
| chromic acid | 9 g/l |
| magnesium sulphate heptahydrate | 2 g/l |
| acetic acid | 3 g/l |
| nitric acid | 3.5 g/l |
| lithium carbonate | 0.06 g/l |
| distilled water | to make 1 liter |

for a period of 45 seconds at a temperature of 25 degrees C.

The sheet was then washed with tap water and immersed in a sealing solution having the following formulation:

| | |
|---|---|
| Sodium silicate ($SiO_2$:$Na_2O$ 4:1) 23% $SiO_2$ | 180 g/l |
| lithium carbonate | 0.3 g/l |
| sodium fluoride | 5 g/l |
| triazol phosphoric ester (Sandocorin 8015 liquid) | 5 g/l |
| cationic surface active agent (Fluorade FC135) | 0.02 g/l |
| distilled water | to make 1 liter |

for a period of 1 minute 30 seconds at a temperature of 70 degrees C. and a pH of 11.

The sheet was then left to dry without prior washing and allowed to stand for 48 hours before making the corrosion test. After this period of time, thermal treatment was applied for 1 hour at 120 degrees C.

The sheet withstood 750 hours for white corrosion (ASTMB 117, NaCl 5% neutral).

EXAMPLE 3

A sheet of steel (100 mm × 50 mm) was immersed in a zinc non-cyanide electrolyte and plated at 2 A/dm$^2$ for 20 minutes at 25 degrees C. After washing it with tap water, the steel sheet was immersed in a solution of yellow chromate with the following formulation:

| | |
|---|---|
| chromic acid | 8 g/l |
| magnesium sulphate heptahydrate | 2 g/l |
| acetic acid | 2.5 g/l |
| nitric acid | 3 g/l |
| lithium carbonate | 0.06 g/l |
| distilled water | to make 1 liter |

for a period of 45 seconds at a temperature of 25 degrees C.

The sheet was then washed with tap water and immersed in a sealing solution having the following formulation:

| | |
|---|---|
| Sodium silicate ($SiO_2$:$Na_2O$ 4:1) 23% $SiO_2$ | 190 g/l |
| lithium carbonate | 0.3 g/l |
| sodium fluoride | 4 g/l |
| triazol phosphoric ester (Sandocorin 8015 liquid) | 4 g/l |
| cationic surface active agent (Fluorad FC135) | 0.03 g/l |
| distilled water | to make 1 liter |

for a period of 1 minute 30 seconds at a temperature of 70 degrees C. and a pH of 10.5.

The sheet was then left to dry without prior washing and allowed to stand for 48 hours before making the corrosion test. After this period of time, thermal treatment was applied for 1 hour at 120 degrees C.

The sheet withstood 700 hours for white corrosion (ASTMB117, NaCl 5% neutral).

While the above specification and examples have been given for purposes of disclosing the preferred embodiment of the present invention, they are not to be construed to be limiting of this invention. It will be readily appreciated by those skilled in the art, that the present invention can be practiced other than as specifically stated. Accordingly, the scope of the present invention shall be limited only with reference to the appended claims and the equivalents thereof.

What is claimed is:

1. A process for forming improved chromate conversion coatings on zinc surfaces which comprises treating the zinc surface with an aqueous acidic chromating solution having a pH of from 0.6 to 2.2 and containing an effective amount of hexavalent chromium and a soluble inorganic salt having an cation which will form an insoluble inorganic silicate, forming a chromate conversion coating on said surface and, thereafter, treating the thus-formed chromate conversion coating with an aqueous alkaline silicate solution having a pH of at least 9.0 and containing an effective amount of a soluble alkali metal silicate and fluoride ions to form an insoluble silicate containing coating on said conversion coating.

2. The process of claim 1 wherein the chromating solution has the following composition:

| | |
|---|---|
| Chromic Acid | 2–15 g/l |
| Magnesium Sulfate, heptahydrate | 0.5–15 g/l |
| Nitric Acid | 0.5–5 g/l |
| Lithium Carbonate | 0.02–2 g/l |
| Acetic Acid | 0–10 g/l |

and the silicate solution has the following composition:

| | |
|---|---|
| Sodium Silicate ($SiO_2$: $Na_2O$ = 2–5:1) | 150–250 g/l |
| Sodium Fluoride | 1–8 g/l |
| Lithium Carbonate | 0–2 g/l |
| Triasole Phosphoric Ester | 0–8 g/l |

3. The process of claim 2 wherein the chromating solution has the following composition:

| | |
|---|---|
| Chromic Acid | 6–9 g/l |
| Magnesium Sulfate, heptahydrate | 1.2–2.5 g/l |
| Nitric Acid | 3–3.5 g/l |
| Lithium Carbonate | 0.05–0.06 g/l |
| Acetic Acid | 2.2–3 g/l |

and the silicate solution has the following composition:

| | |
|---|---|
| Sodium Silicate ($SiO_2$:$Na_2O$ = 3–4:1) | 180–200 g/l |
| Sodium Fluoride | 3–5 g/l |
| Triazole phosphoric ester | 3–5 g/l |
| Lithium carbonate | 0.2–0.3 g/l |

4. The process of claim 1 wherein the surfaces to be treated are immersed in the chromating and the silicate solutions.

5. The process of claim 2 wherein the surfaces to be treated are immersed in the chromating and the silicate solutions.

6. The process of claim 3 wherein the surfaces to be treated are immersed in the chromating and the silicate solutions.

7. The process of claim 4 wherein the zinc surface to be treated is a steel substrate on which zinc has been electroplated.

8. The process of claim 5 wherein the zinc surface to be treated is a steel substrate on which zinc has been electroplated.

9. The process of claim 6 wherein the zinc surface to be treated is a steel substrate on which zinc has been electroplated.

* * * * *